United States Patent [19]

Gryctko

[11] 4,090,156

[45] May 16, 1978

[54] CIRCUIT BREAKER HAVING SOLID STATE AND THERMAL-MAGNETIC TRIP MEANS

[75] Inventor: Carl E. Gryctko, Bellefontaine, Ohio

[73] Assignee: I-T-E Imperial Corporation, Spring House, Pa.

[21] Appl. No.: 675,971

[22] Filed: Apr. 12, 1976

[51] Int. Cl.[2] ..... H01H 75/00; H01H 77/00; H01H 83/00

[52] U.S. Cl. ..... 335/6; 335/35

[58] Field of Search ..... 335/18, 6, 23, 35; 361/115

[56] References Cited

U.S. PATENT DOCUMENTS

| | | | |
|---|---|---|---|
| 3,539,867 | 11/1970 | Edmunds | 335/18 |
| 3,558,991 | 1/1971 | Brandt, Jr. et al. | 361/115 |
| 3,636,482 | 1/1972 | Edmunds | 335/18 |
| 3,826,951 | 7/1974 | Mater et al. | 335/172 |

*Primary Examiner*—Harold Broome

*Attorney, Agent, or Firm*—Ostrolenk, Faber, Gerb & Soffen

[57] ABSTRACT

A molded case multi-pole circuit breaker is provided with a solid state trip unit constructed to automatically open the breaker responsive to predetermined fault current conditions by actuating a permanent magnet latch. The circuit breaker is also provided with a thermal-magnetic trip means that acts independently of the solid state trip unit to automatically open the breaker responsive to predetermined fault current conditions.

5 Claims, 1 Drawing Figure

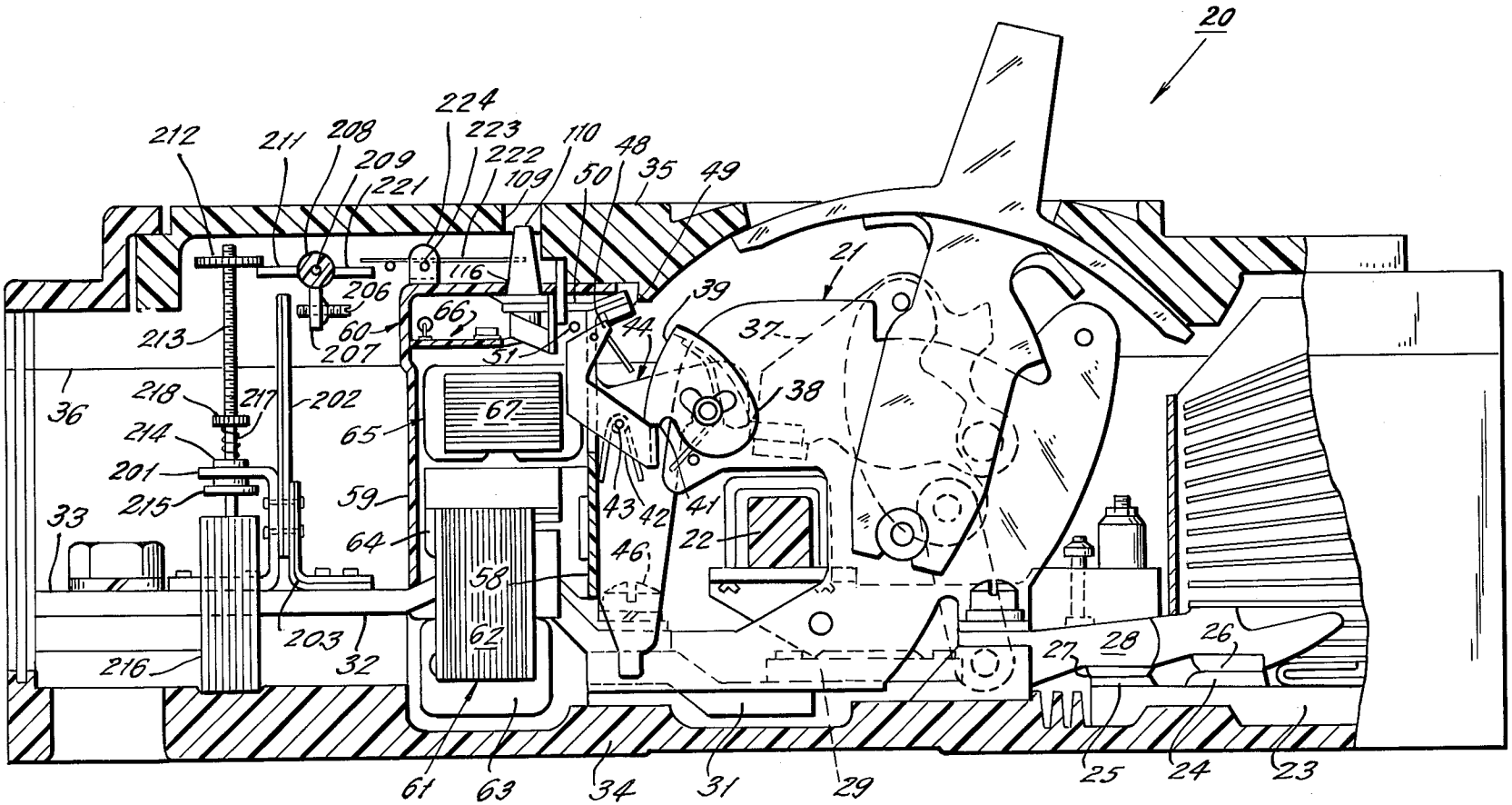
20
21
22
23
24
25
26
27
28
29
31
32
33
34
35
36
37
38
39
41
42
43
44
46
48
49
50
51
56
58
59
60
61
62
63
64
65
66
109
110
116
201
202
203
206
207
208
209
211
212
213
214
215
216
217
218
221
222
223
224

CIRCUIT BREAKER HAVING SOLID STATE AND THERMAL-MAGNETIC TRIP MEANS

This invention relates to molded case multi-pole circuit breakers in general and more particularly relates to breakers of this type having solid state automatic trip units responsive to predetermined fault current conditions.

In order for a circuit breaker to provide maximum protection for a given load without tripping falsely, its tripping characteristics must be tailored to withstandability of the load against damage due to overheating and electromagnetic effects. This is particularly important for a multi-pole molded case circuit breaker having a relatively high continuous current carrying capacity, say in excess of 800 amps.

It has been known for some time that trip units utilizing solid state circuitry are more readily adjusted over a wider range of characteristics than are conventional magnetic trip units. In addition, solid state trip units achieve greater accuracy and repeatability, and with relatively simple adjustments obtain more complex time versus current characteristics. One such solid state trip unit is disclosed in the G. Gaskill co-pending application, Ser. No. 671,077, filed Mar. 29, 1976, and assigned to the assignees of the instant invention, as well as on other applications referred to in said application Ser. No. 671,077

In particular, the solid state trip unit of the aforesaid application, Ser. No. 671,077, constantly monitors current conditions in the breaker and includes processing circuitry which generates a control signal which actuates a permanent magnet latch upon the occurrence of predetermined fault current conditions in the circuit breaker. When the latch is released spring stored energy in the latch actuates the circuit breaker trip mechanism for opening of the circuit breaker contacts.

In accordance with the instant invention a molded case circuit breaker having a solid state trip unit is also provided with a thermal-magnetic trip means that acts independently of the solid state trip unit. Thus, in the event the solid state unit fails completely or otherwise malfunctions, upon the occurrence of predetermined fault current conditions the thermal magnetic unit assures that the circuit breaker trips. Inclusion of the thermal-magnetic unit may serve to simplify the electronics of the solid state unit in that the latter need not have tripping characteristics which duplicate either the thermal or magnetic tripping characteristics.

Accordingly, a primary object of the instant invention is to provide a novel construction for a multi-pole circuit breaker having a solid state automatic trip means.

Another object is to provide a circuit breaker of this type which also includes thermal and/or magnetic trip means that is responsive to current flowing in the main conductors of the circuit breaker and is operable independently of the solid state trip means.

These objects as well as other objects of this invention shall become readily apparent after reading the following description of the accompanying drawing in which the single FIGURE is a longitudinal cross-section through the center pole of a three pole molded case circuit breaker constructed in accordance with teachings of the instant invention.

Now referring to the FIGURE. Molded case circuit breaker 20 is a three pole unit with a common spring powered contact operating mechanism 21 all disposed within a molded insulating housing consisting of base 34 and cover 35 which is separable from base 34 at line 36. Transverse insulating bar 22 provides a mechanical tie between the movable current carrying elements of all three poles for simultaneous operation thereof in a manner well known to the art.

The current carrying path through the center pole consists of line terminal member 23, stationary arcing and main contacts 24, 25, movable arcing and main contacts 26, 27, movable contact arm 28, flexible conductor 29, strap 31, and main bus section 32 which terminates in load terminal 33. Removable screw 46, extending through a clearance aperture in the line ends of bus 32, provides contact pressure between bus 32 and strap 31. The two outer poles of breaker 20 have essentially the same current carrying elements as the center pole just described.

Contact operating mechanism 21 is a conventional trip free spring powered over center toggle unit including releasable cradle 37 which is normally held in the reset position shown in the FIGURE by latching portion 38 of auxiliary latch 39. At point 41 auxiliary latch 39 is held by engagement with main latch 42 which is pivotally mounted to support bracket 44 on pin 43. The end of main latch remote from point 41 is provided with nose 48 that is normally engaged by latching plate 49 on trip member 50. The latter is pivotally mounted to bracket 44 on pin 51.

As explained in detail in the aforesaid application, Ser. No. 671,077, bracket 44 and the elements mounted thereto constitute a subassembly which together with all three main buses 32 are elements of solid state trip unit 60 disposed within circuit breaker housing 34, 35 at the load end thereof. Unit 60 also includes a common insulating frame or housing consisting of member 58 having a U-shaped cross-section and member 59 having an L-shaped cross-section with the latter constituting a removable cover. Main conductors 32 are positioned at the bottom of housing 58, 59, when viewed with respect to the FIGURE and extend beyond both the line and load sides of housing 58, 59. Bracket 44 and the elements mounted thereon constitute a subassembly mounted to frame member 58 with the major portion of bracket 44 abutting the line side of member 58 with pivot 51 for trip member 50 being positioned at the upper end of member 58.

Each main bus 32 constitutes a single turn primary for an individual input transformer 61 provided for each pole of the circuit breaker 20. Each input transformer 61 also includes square laminated magnetic frame or core 62 through which primary 32 extends. The multi-turn secondary of transformer 61 consists of multi-turn coils 63, 64 wound around opposite legs of core 62 and connected in series aiding relationship. The output of secondary 63, 64 is fed through the multi-turn primary of output transformer 65 whose secondary feeds the solid state control circuitry on circuit board 66. Output transformer 65 is provided with square laminated magnetic frame or core 67 having coil means mounted on opposite legs thereof with each of these coil means consisting of a portion of the primary and a portion of the secondary for output transformer 65. These primary portions are connected in series aiding relationship as are these secondary portions. In total, the secondary of transformer 65 has many more turns than the primary.

As explained in application Ser. No. 671,077, upon the occurrence of predetermined overload conditions in conductors 32, the solid state processing circuitry on board 66 generates a control signal that trips a permenent magnet latch (not shown) located within housing 58, 59. Tripping of this latch pivots trip member 50 counterclockwise to trip mechanism 21 and open circuit breaker 20.

Depressible trip member 110 projects upward through aperture 116 in trip unit housing cover 59 and is operatively positioned to operate trip member 50. When member 110 is depressed by an instrument inserted through hole 109 in cover 35, trip member 50 is pivoted counterclockwise to trip contact operating mechanism 21.

Secured to the upper surface of main conductor 32 on the load side of solid state trip unit 60 is reverse C-shaped insulating member 201 having the lower end of bimetal strip 202 secured to the web portion thereof. L-shaped heat conducting lamination stack 203 is secured at one end to main conductor 32 and at the other end to the lower end of bimetal 202 so that heat generated in conductor 32 is conducted efficiently to bimetal 202 to cause heating thereof which deflects the upper end of bimetal 202 to the right into engagement with calibration screw 206. The latter extends through radial projection 207 of transverse trip bar 208 that is mounted for pivotal movement about its longitudinal axis 209.

Trip bar 208 also includes radial projection 211 positioned for engagement by nut 212 which is threadably mounted on vertical shaft 213 near its upper end. The lower end of shaft 213 extends through bearing means 214 secured to the upper horizontal leg of insulating member 201 at an aperture therethrough. Magnetic armature 215 is secured to shaft 213 below the upper horizontal leg of member 201 and is biased upward by coiled compression spring 217 that is interposed between bearing means 214 and nut 218 threadably mounted to shaft 213 above bearing means 214. U-shaped yoke 216 is positioned below armature 215 in alignment therewith and straddles main conductor 32, with the latter being the energizing turn for magnet 215, 216.

When current of sufficient magnitude flows in conductor 32 magnet 215, 216 is energized causing armature 215 to move downward moving shaft 213 axially downward so that nut 212 engages projection 211 to rotate trip bar 208 counterclockwise. This causes radial projection 221 of trip bar 208 to move upward into engagement with the left end of crank 222. The latter is mounted to pivot 223 that extends between the arms of U-shaped bracket 224 whose web is secured to the upper surface of cover 59. Thus, engagement of the left end of crank 222 by projection 221 as the latter moves upward causes crand 222 to pivot clockwise. This moves the right end thereof downward and since it is in engagement with control 110, the latter moves downward. As previously explained, downward movement of control 110 pivots trip member 50 counterclockwise releasing latch member 42 and tripping contact operating mechanism 21. In a similar manner, when the temperature of bimetal 202 rises sufficiently the upper end thereof deflects to the right to engage screw 206 and pivot trip bar 208 counterclockwise so that projection 221 thereof pivots crank 222 clockwise to cause tripping of mechanism 21.

It should now be apparent to those skilled in the art that each pole of circuit breaker 20 is provided with an individual thermal trip element 202, an individual magnetic trip means 215, 216 and individual projections 207 and 211 extending from trip bar 208. The latter extends through all three poles of breaker 20.

In the event that the electrical elements of solid state trip unit 60 should fail to function, upon the occurrence of predetermined fault current conditions operation of bimetal 202 or magnet 215, 216 will cause tripping of circuit breaker 20. Since circuit breaker 20 includes a thermal-magnetic trip means, those portions of the processing circuitry for solid state trip unit 60 which performs over the tripping range sections provided by bimetal 202 and magnet 215, 216 may be dispensed with.

Although there has been described a preferred embodiment of this novel invention, many variations and modifications will now be apparent to those skilled in the art. Therefore, this invention shall not be limited by the specific disclosure herein, but only by the appended claims.

What is claimed is:

1. A circuit breaker including cooperating contact means; a spring powered mechanism for opening and closing said contact means; latch means for maintaining said mechanism in a reset position for closing said contact means; main conductor means in series with said contact means; an insulating housing wherein said contact means, said mechanism, said latch means and said conductor means are disposed; a solid state trip means disposed within said housing inductively coupled to said conductor means and operatively connected to said latch means for normally tripping same upon the occurrence of first predetermined overload fault current conditions in said conductor means thereby unlatching said mechanism for opening said contact means; and additional means within said housing coupled to said conductor means and operative independently of said solid state trip means upon the occurrence of second predetermined overload fault current conditions for tripping said latch means to unlatch said mechanism thereby opening said contact means; said additional means being constructed to trip said latch means in the event said solid state trip means fails to trip said latch means responsive to said first predetermined current conditions.

2. A circuit breaker as set forth in claim 1 in which the additional means includes a thermally actuated means conductively coupled to the conductor means.

3. A circuit breaker as set forth in claim 1 in which the additional means includes a magnetically actuated means inductively coupled to the conductor means.

4. A circuit breaker as set forth in claim 3 in which the additional means also includes a thermally actuated means conductively coupled to the conductor means.

5. A circuit breaker as set forth in claim 1 in which at any instant said conductor means carries current in only one direction.

* * * * *